United States Patent [19]

Ikeda et al.

[11] 4,304,974

[45] Dec. 8, 1981

[54] ENERGY SUPPLY STRUCTURE FOR COMBINED RESISTANCE HEATER FOR H. F. HEATER OVEN

[75] Inventors: Nobuo Ikeda; Hirofumi Yoshimura, both of Nara, Japan

[73] Assignee: Matsushita Electric Industrial Co., Ltd., Osaka, Japan

[21] Appl. No.: 122,808

[22] Filed: Feb. 19, 1980

[30] Foreign Application Priority Data

May 4, 1979 [JP] Japan ..... 54-54991

[51] Int. Cl.[3] ..... H05B 6/72

[52] U.S. Cl. ..... 219/10.55 F; 219/10.55 B

[58] Field of Search ..... 219/10.55 F, 10.55 B, 219/10.55 R, 10.55 E

[56] References Cited

U.S. PATENT DOCUMENTS

| | | | |
|---|---|---|---|
| 2,961,520 | 11/1960 | Long | 219/10.55 F |
| 3,265,780 | 8/1966 | Long | 219/10.55 F X |
| 4,028,521 | 6/1977 | Uyeda et al. | 219/10.55 F |
| 4,185,181 | 1/1980 | Kaneko et al. | 219/10.55 F |

FOREIGN PATENT DOCUMENTS

| | | | |
|---|---|---|---|
| 2844128 | 4/1979 | Fed. Rep. of Germany | 219/10.55 F |

*Primary Examiner*—Gene Z. Rubinson
*Assistant Examiner*—Philip H. Leung
*Attorney, Agent, or Firm*—Wenderoth, Lind & Ponack

[57] ABSTRACT

A heating appliance such as a stove which has a high frequency and resistance heater therein. A high frequency oscillator supplies frequency radiation energy through a waveguide extending to a energy feeding port in the heating chamber, and a rotary antenna extends through the energy feeding port for directing the high frequency energy into the heating chamber. A motor rotates the antenna, a heater of a type other than a high frequency heater, such as a resistance heater, is in the heating chamber substantially parallel with the wall of the heating chamber in which the energy feeding port is positioned. The rotary antenna has substantially an L shape with a longitudinal section extending from the waveguide into the heating chamber through the energy feeding port, the portions of the longitudinal section within the heating chamber from the wall in which the energy feeding port is positioned to the inner end thereof having a length substantially equal to one quarter the wavelength of the high frequency energy, and a lateral section connected to the longitudinal section at a point intermediate the length thereof within the heating chamber at a point between the wall of the heating chamber and the resistance heater.

4 Claims, 3 Drawing Figures

ENERGY SUPPLY STRUCTURE FOR COMBINED RESISTANCE HEATER FOR H. F. HEATER OVEN

This invention relates to an energy supplying structure for a heating appliance having an electric resistance heating means and a high frequency energy dielectric heating means. The invention is particularly applicable to the oven of a stove or the like.

BACKGROUND OF THE INVENTION AND PRIOR ART

In a heating appliance having a non-high frequency dielectric heater means, such as an electric resistance heater, and a dielectric heating means, it is very useful to rotate the antenna of the dielectric heating means. In dielectric heating, where the high frequency energy which is radiated varies from time to time, rotation of the antenna ensures a uniform distribution of the electric field. The antenna is normally in the shape of a rod and does not obstruct the heat being given off by the resistance heater means and the temperature distribution in the heating chamber is not disturbed even when the antenna is rotated between the resistance heater means and the position of the object to be heated.

However, when the resistance heater is above the object to be heated and an L-shaped antenna has the horizontal arm below the resistance heater means and rotated around the vertical arm as the rotational axis, the antenna may come in contact with the object to be heated and stop rotating and cause uneven heating, which offsets the advantage of this arrangement that it improves the high frequency electric field distribution and high frequency output level. Moreover, since the antenna may be damaged when contacted by the operator's hand or the object to be heated when the object to be heated is introduced into or removed from the heating chamber, it should be made of a sufficiently hard material that it is not damaged. Accordingly, it becomes relatively expensive.

On the contrary, when the horizontal arm of the L-shaped antenna is rotated in a plane above the resistance heater means, it is disadvantageous in that the length of the horizontal arm must be shorter and high frequency output level is reduced, especially in a small sized appliance, even though the heater means provides protection for preventing the antenna from being contacted by the object being heated.

If the horizontal arm of the antenna is flush with the resistance heater means, then the length thereof is even further limited. Where the dimension of the antenna is made such that good dielectric heating is achieved, uneven heating occurs when the resistance heater means is in operation.

It is an object of the present invention to provide an energy supplying structure which avoids the disadvantage of causing deterioration of the heating performances of both the resistance heater means and the dielectric heating means, of occupying a large space in the upper portion of the heating chamber so as to reduce the effective volume of the heating chamber of having the rotary antenna damaged by being contacted by the operator's hand or the object to be heated when the object is being introduced into and removed from the heating chamber, and of obstructing the rotation of the rotary antenna during the heating operation. This object is accomplished by rotating the antenna for radiating high frequency energy at a level above the resistance heater means which is located in an upper portion of the heating chamber.

The energy supply construction according to the present invention has an L-shaped antenna with a vertical arm having a dimension such that it operates as a so-called ¼ wavelength dipole antenna, and with a horizontal arm disposed between a resistance heater means and the top wall of the heating chamber.

BRIEF DESCRIPTION OF THE DRAWINGS

An embodiment of the present invention will now be described with reference to the accompanying drawings, in which.

DETAILED DESCRIPTION OF THE INVENTION

Figure 1:
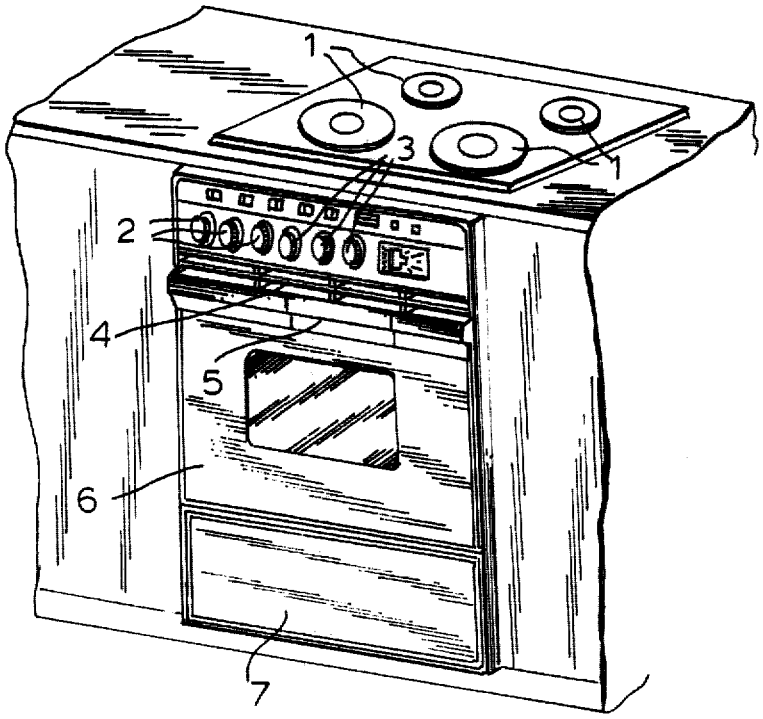
FIG. 1 is a perspective view of an embodiment of a specific heating appliance, namely a stove, incorporating therein one embodiment of the present invention.

The heating appliance shown in FIG. 1 is a built-in stove within a sink and has four electric burners 1 on the top surface. Each of the electric cooking burners 1 is controlled by one of a plurality of knobs 2 on a front panel of the heating appliance, the panel further having control knobs 3 for the heating appliance.

A cooling air inlet and outlet 4 is provided below the front panel and above a door 6 having a handle 5. A drawer 7 is disposed below the body of the heating appliance for storing miscellaneous goods such as attachments.

Figure 2:
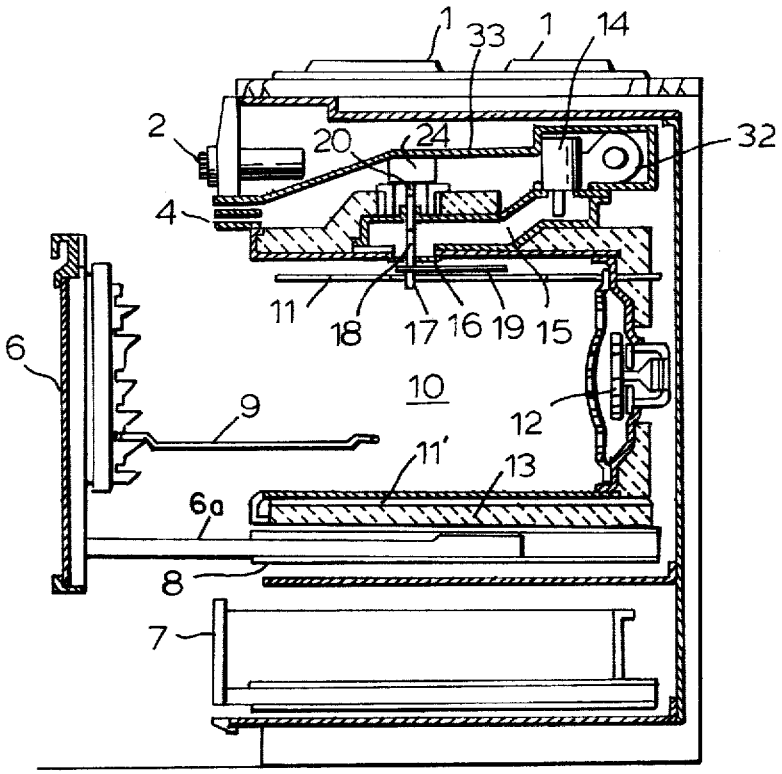
FIG. 2 is an elevation view in cross section of the appliance of FIG. 1.
Figure 3:
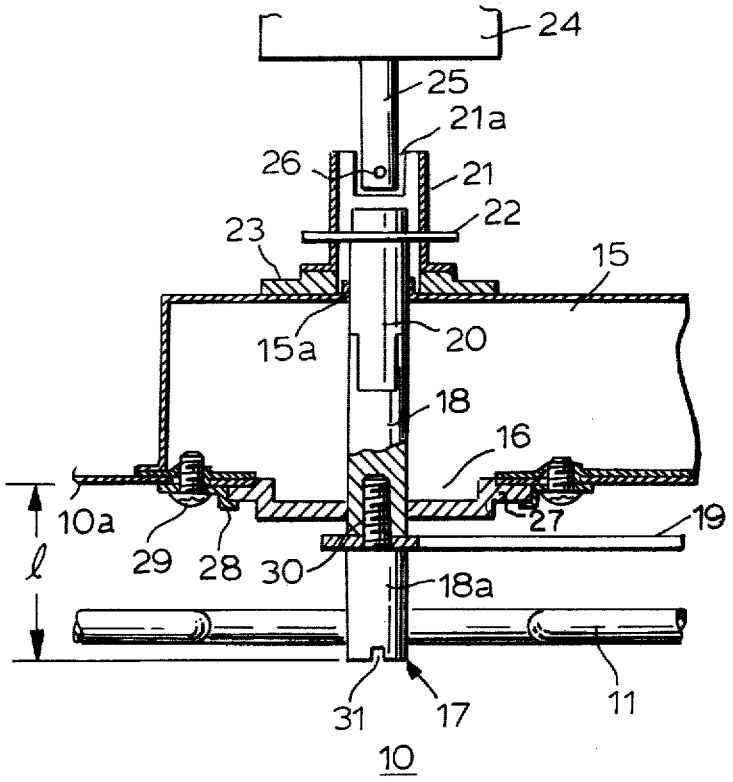
FIG. 3 is an enlarged cross sectional view of the high frequency supply structure.

As shown in FIGS. 2 and 3, the door 6 is mounted on a frame piece **6*a* which in turn is slidable on a rail 8 and mounted on the inner surface of the door 6 is a shelf 9 on which an object to be heated, such as food or the like, is to be placed. The shelf 9 thus moves with the door 6 when it is closed and opened for inserting and removing food from the heating chamber 10. An upper electric resistance type heater 11 is disposed inside the heating chamber 10 and in juxtaposition with a top wall of the chamber whereas a lower electric resistance type heater 11'** is disposed below the bottom wall of the chamber.

A hot air circulating fan 12 is disposed behind the rear wall of the heating chamber 10 for ensuring uniform temperature distribution throughout the heating chamber. A heat insulating member 13 is provided around the outer periphery of the heating chamber 10 to prevent heat from escaping from the outer walls of the heating chamber and thus ensuring a higher degree of heat efficiency. A high frequency oscillator 14 or a magnetron is coupled with a Z-shaped waveguide 15 for transmission of high frequency energy therethrough, one end of the waveguide 15 also being in communication with an energy feeding port 16 formed at about the center of the top wall **10*a* of the heating chamber 10. An L-shaped rotary antenna 17 is provided which has a rotatable vertical or lateral leg 18 lying along the axis of the energy feeding port 16, and a horizontal or longitudinal leg 19 extending from the lower end of the vertical leg. One end of the vertical leg of the antenna 17 is connected to an antenna drive shaft 20 made of a low loss dielectric material such as alumina porcelain, which shaft 20 in turn extends through a journal 15*a* in the upper wall of the waveguide 15 and is secured to a rotating shaft 21 by means of a pin 22**. The rotating shaft 21 is rotatably mounted on a thrust bearing 23 affixed to the outside of the upper wall of the waveguide 15 and is in turn connected by a lost motion connection to a motor shaft 25 of a driving motor 24. The lost motion connection is a pin 26 on the motor shaft 25 positioned in notches 21*a* in shaft 21.

Accordingly, the rotary antenna 17 rotates smoothly after rotation of the motor shaft 25 has started and the lost motion connection has become a firm connection.

A seal plate 27 made of a low loss dielectric material is secured over the energy feeding port 16 to prevent hot air in the heating chamber 10 from flowing into the magnetron 14 through the waveguide 15 and engages shaft 18 in bearing engagement. A seal plate flange 28 has an edge overlapping plate 27 and flange 28 is held on waveguide 15 by screws 29. The rotary antenna 17 is therefore journaled at the seal plate 27 and the upper wall of the waveguide 15. The horizontal leg 19 of the rotary antenna 17 is attached to the vertical leg 18 by an additional leg or portion 18*a* of the leg 18. The attachment is made by threading the threaded portion 30 of the portion 18*a* into the vertical leg 18 with the leg 1*a* fixed therebetween. The leg 19 is thus positioned in the space between the top wall of the heating chamber 10 and the upper heater 11 within the heating chamber. Thus, the threaded portion 30 of the portion 18*a* is threaded the lower end of the vertical leg 18. Numeral 31 is a slot which is provided at the lower end of the additional vertical leg 18*a* in order to threadably connect the additional vertical leg 18*a* by a screwdriver to the leg 18.

The vertical leg 18 and the additional vertical leg 18*a* of the rotary antenna 17 within the heating chamber 10 has a length l, i.e., the length from the top wall 10*a* of the heating chamber to the lower end of the additional vertical leg 18*a* is substantially equal to one quarter of the wavelength of the high frequency energy supplied from the magnetron 14, so that the vertical leg 18 and 18*a* serves as a $\frac{1}{4}$ wavelength dipole antenna for radiating high frequency energy with an electric field in a vertical direction while the horizontal leg 19 radiates high frequency energy with an electric field in a horizontal direction during rotation, thereby assuring a uniform electric field distribution.

In other words, the vertical leg 18*a* of the rotary antenna 17 mainly increases the high frequency output and the horizontal leg 19 improves the high frequency distribution, thereby assuring desirable electric field distribution in an efficient manner.

In addition, the horizontal leg 19 of the rotary antenna is safeguarded against contact with the object to be heated by the upper heater 11 during rotation. In the event that the lowest end of the additional vertical leg 18*a* contacts the object to be heated, the antenna does not stop rotating since that portion of the antenna is located substantially on the axis of rotation of the antenna. This effect is achieved even if the lowest portion of the additional vertical leg 18*a* of the rotary antenna is as short as head of a conventional screw.

A cooling fan 32 is provided to draw cooling air into some of the ventilation holes 4 and through an air guide 33 for cooling the magnetron 14, and to discharge the air through other holes 4.

In operation, the high frequency energy from the magnetron 14 travels through the Z-shaped waveguide 15 and enters the heating chamber 10 through the rotary antenna 17 driven by the motor 24. Cooling air is drawn from some of the ventilation holes 4 and discharged from others of the holes 4 after cooling magnetron 14.

Because of the structure as described above, the present invention ensures excellent electric field distribution throughout the heating chamber. There is no possibility that the rotary antenna will contact the object to be heated, such as food or the like, and discontinue rotating, since the horizontal leg of the rotary antenna rotates in a plane above the upper heater and is safeguarded by that heater. Output efficiency is enhanced because the vertical leg of the rotary antenna serves as a $\frac{1}{4}$ wavelength dipole antenna. The heaters and the antenna occupy a reduced space with a resulting increase in the effective volume of the heating chamber. If the antenna is plated with a highly conductive material such as silver, high frequency loss in the antenna is reduced to a minimum, resulting in a higher degree of output efficiency.

While the preferred oven structure has the rotary antenna rotating in a horizontal plane just below the top wall of the heating chamber, it will be clear that the invention is not limited to such a structure. The shaft of the rotary antenna can project through the rear wall, a side wall or the bottom wall, and it will still be equally effective.

What is claimed is:

1. A heating appliance comprising:

a heating chamber for heating objects to be disposed therein and having a top wall, a bottom wall, a rear wall, and opposing side walls;

an energy feeding port extending through one of said walls;

a high frequency oscillator for generating high frequency radiation energy;

a waveguide extending from said oscillator to said energy feeding port;

a rotary antenna extending through said energy feeding port for directing high frequency energy into said heating chamber;

a drive means being connected to said rotary antenna for rotating said antenna;

a non-high frequency type heater means being disposed within said heating chamber and being substantially parallel with the wall which said energy feeding port extends therethrough;

said rotary antenna being substantially L shaped and having a longitudinal leg and a lateral leg, said longitudinal leg being extended from said waveguide, through said energy feeding port, and into said heating chamber; said lateral leg being connected to said longitudinal leg within said heating chamber and at a point intermediate the end of the longitudinal leg within said heating chamber and the portion of said longitudinal leg which is adjacent to said energy feeding port, and the portion of said longitudinal leg within said heating chamber being of a longitudinal length substantially equal to one quarter of the wavelength of the high frequency energy generated by said oscillator; and the portion of said rotary antenna situated within said heating chamber being located within the space defined between said heater means and the wall which said energy feed port extends therethrough.

2. A heating appliance as claimed in claim 1 in which the surface of said rotary antenna is plated with a highly conductive metallic material.

3. A heating appliance as claimed in claim 1 in which said heater means is an electric resistance heater.

4. A heating appliance as claimed in claim 1 in which the most inwardly extending portion of said rotary antenna with respect to the center of said heating chamber is at a distance closer to said center than the most inwardly extending portion of said heater means.

* * * * *